United States Patent [19]

Hilal

[11] 4,223,723

[45] Sep. 23, 1980

[54] HEAT TRANSFER IN BOILING LIQUIFIED GAS

[75] Inventor: Mohamed A. Hilal, Madison, Wis.

[73] Assignee: Wisconsin Alumni Research Foundation, Madison, Wis.

[21] Appl. No.: 869,019

[22] Filed: Jan. 12, 1978

[51] Int. Cl.[2] ..... F28F 13/02

[52] U.S. Cl. ..... 165/133; 62/64; 62/373; 165/105; 165/DIG. 11

[58] Field of Search ..... 165/133, 169, 80, DIG. 11, 165/105, 106, 108, 80 R, 80 E; 62/527, 64, 63, 373, 514 R, 62; 219/271, 275, 316, 318, 335, 336

[56] References Cited

U.S. PATENT DOCUMENTS

| | | | |
|---|---|---|---|
| 1,845,690 | 2/1932 | Wait | 165/108 |
| 2,304,488 | 12/1942 | Tucker | 62/50 |
| 2,873,350 | 2/1959 | Barnes | 219/316 |
| 2,873,954 | 2/1959 | Protze | 165/105 |
| 3,009,045 | 11/1961 | Porter | 165/185 |
| 3,279,534 | 10/1966 | Schwaiger et al. | 165/108 |
| 3,392,781 | 7/1968 | Zuber et al. | 165/133 |
| 3,417,814 | 12/1968 | Oktay | 165/105 |
| 3,441,081 | 4/1969 | Collis et al. | 165/105 |
| 3,541,487 | 11/1970 | Leonard | 165/105 |
| 3,550,781 | 12/1970 | Barron | 219/275 |
| 3,586,101 | 6/1971 | Chu et al. | 165/105 |
| 3,656,545 | 4/1972 | Van Loo | 165/105 |
| 3,750,745 | 8/1973 | Moore, Jr. | 165/133 |
| 3,828,849 | 8/1974 | Corman et al. | 165/133 |
| 3,875,754 | 4/1975 | Faust et al. | 62/64 |

*Primary Examiner*—Sheldon Richter

*Attorney, Agent, or Firm*—McDougall, Hersh & Scott

[57] ABSTRACT

Means for increasing heat transfer characteristics between the surface of a solid and a boiling liquid in which the solid is immersed comprising providing a solid with passages which extend therethrough to the surface for the circulation of liquid through said passages for emergence from the surface to eliminate at least a portion of the unstable vapor film otherwise formed on the surface.

9 Claims, 7 Drawing Figures

HEAT TRANSFER IN BOILING LIQUIFIED GAS

This invention relates to improvements in heat transfer characteristics of boiling liquids at the heat transfer surface.

Techniques to improve heat transfer to boiling fluids has been the subject matter of studies made by a number of investigators. Young and Hummel, Chem. Engr. Prog. 60 53 (1964) suggested a novel method wherein spots of Teflon or other non-wetting material were found to promote nucleation thereby to improve nucleate boiling. Boiling heat transfer in cryogenic fluids was found to be improved when the surface was covered by layers of frost (R. D. Cummings and J. L. Smith, Liquid Helium Technology, Pergamon Press, Oxford England p. 85 (1966), ice (D. N. Lyon, Chem. Engr. Prog. Symp. Ser. No. 87,64,82 (1968) and varnish (J. Jackson and A. S. Fruin, Second International Conference of Magnet Technolgy, Oxford Press, pp. 494–495 (1967). A. P. Butler et al. in Int. J. Heat Mass Transfer 13:105 (1970) described increase in heat transfer to a pool of boiling helium when the surface was covered with a thin layer of an insulating or porous material. Other methods to improve boiling heat transfer have been proposed but have been found to be unsuccessful.

It is an object of this invention to provide a new and improved means and method for improving heat transfer characteristics of boiling fluids or liquids.

Figure 1:
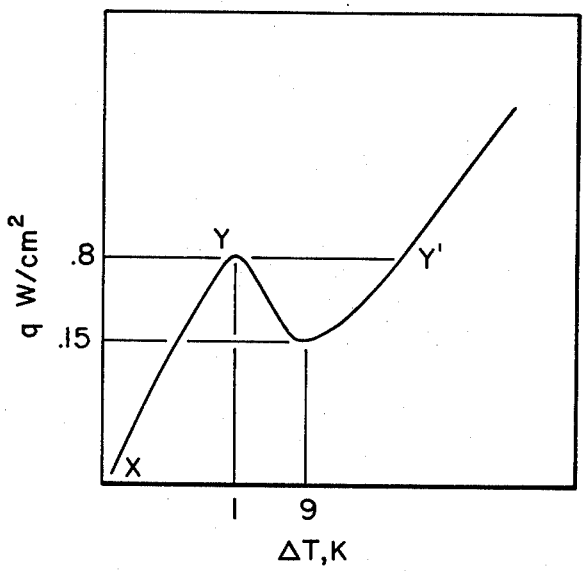
Figure 2:
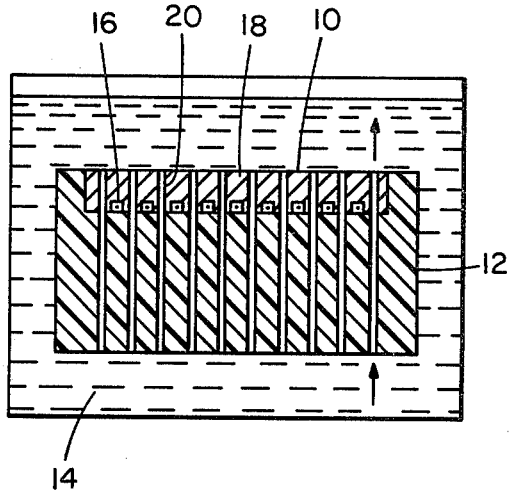
Figure 3:
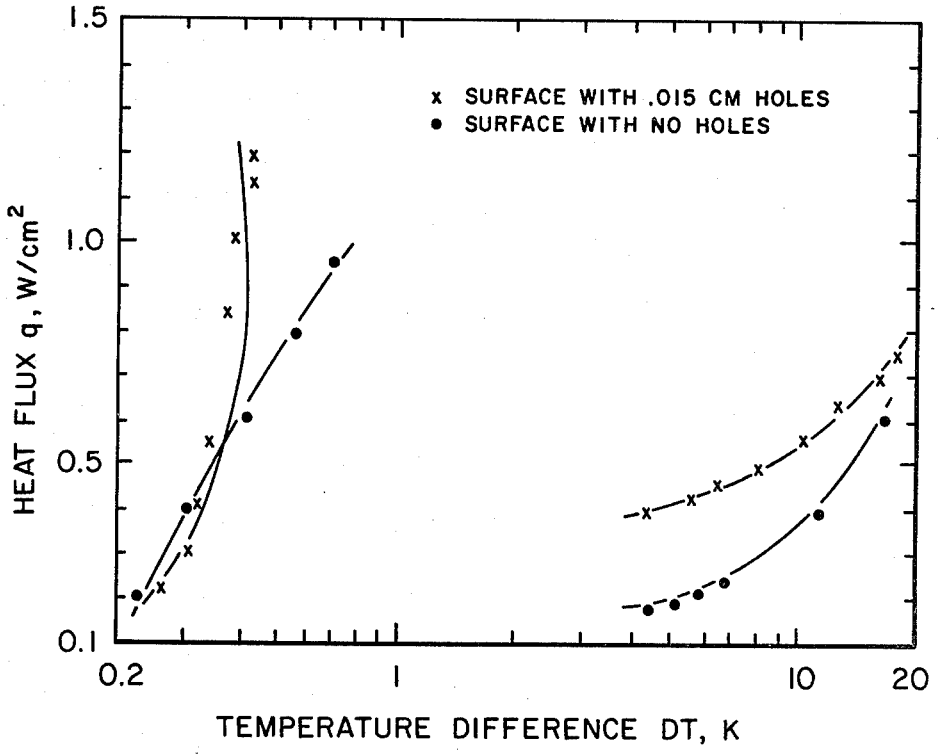
Figure 4:
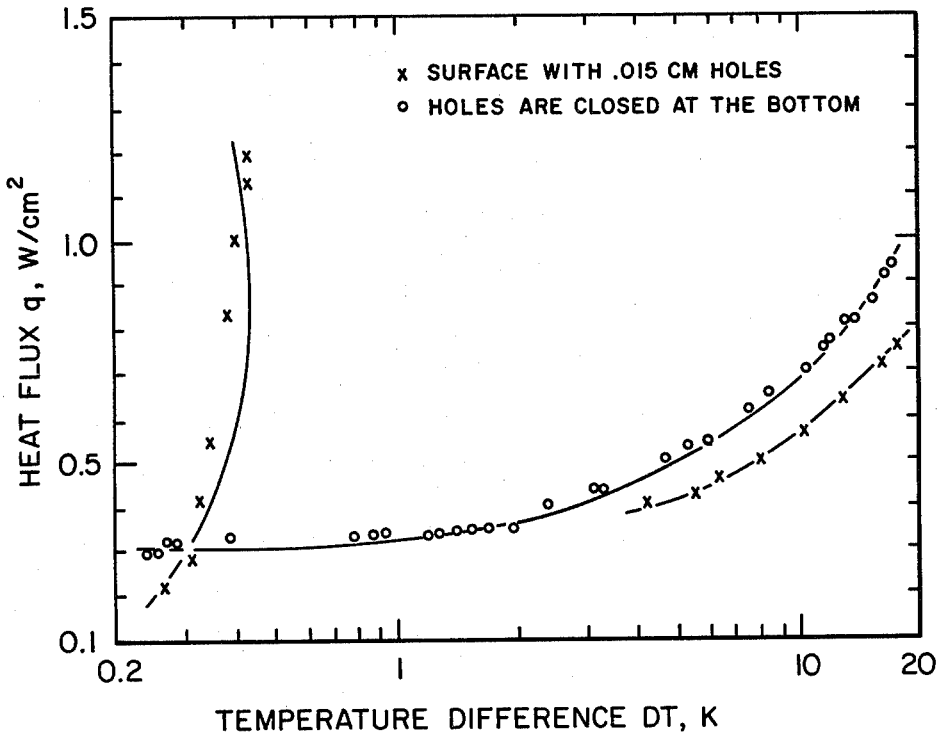
Figure 5:
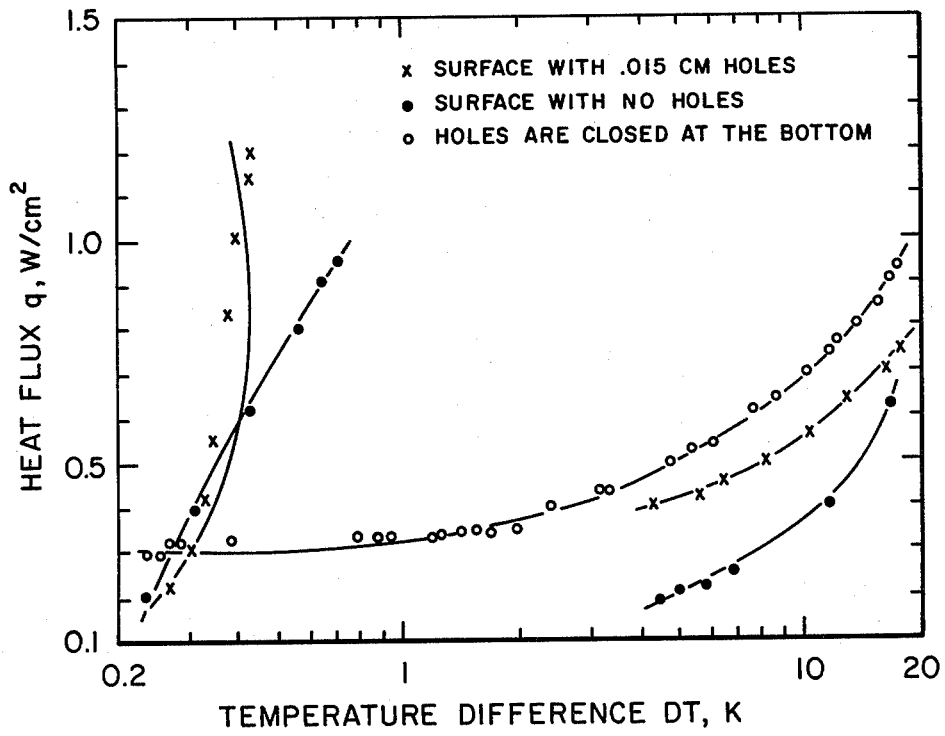
Figure 6:
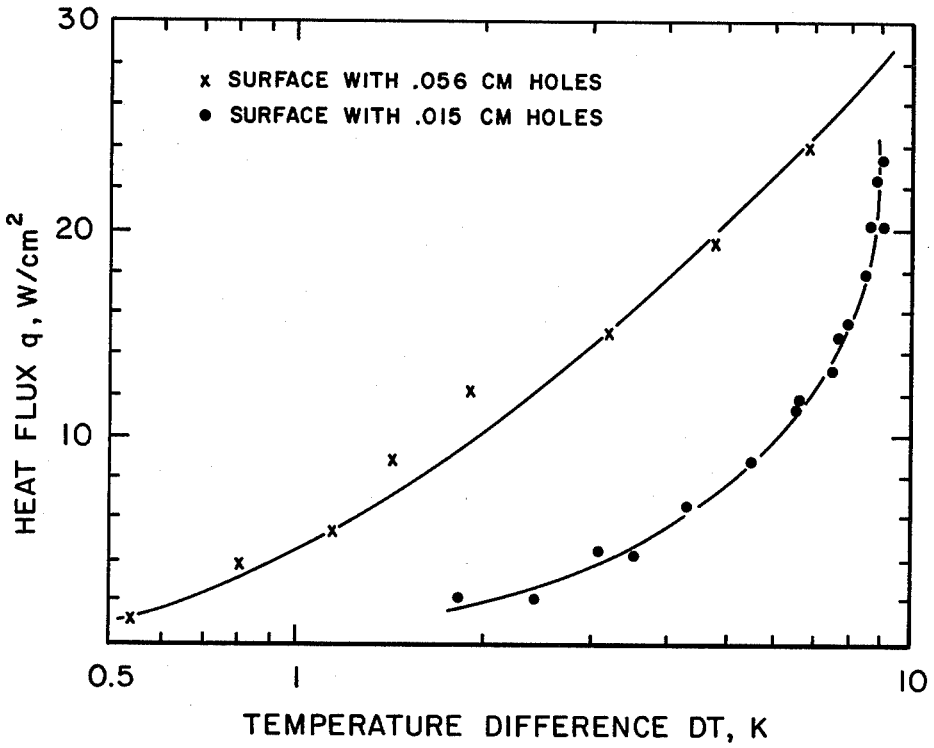
Figure 7:
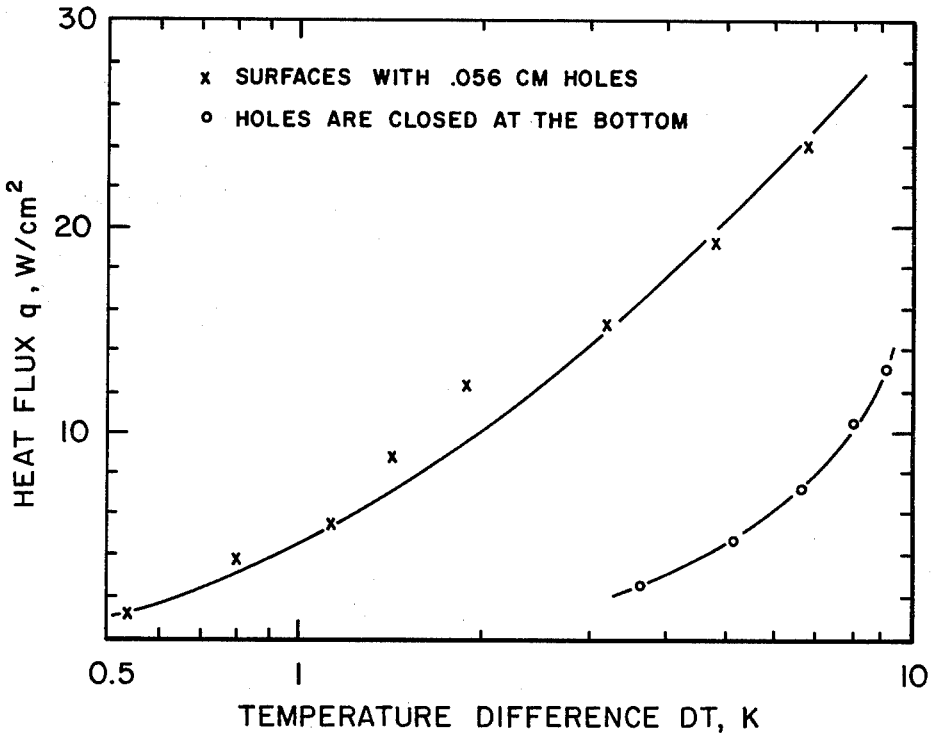

These and other objects and advantages of this invention will hereinafter appear and for purposes of illustration, but not of limitation, an embodiment of the invention is shown in the accompanying drawings in which:

FIG. 1 is a schematic drawing showing the boiling curve for liquid helium, and FIG. 2 is a sectional elevational view of an arrangement for improving boiling heat transfer in accordance with the practice of this invention; and FIGS. 3–5 are boiling curves with liquid helium, and FIGS. 6 and 7 are boiling curves with liquid nitrogen.

The theory on which the invention is based will be described with reference to the boiling curve for liquid helium, as shown schematically in FIG. 1. Boiling by bubble formation and release begins at and rises rapidly in the region of heat differential from X to Y. Beyond Y, film begins to form on the surface to create an unstable film boiling regime in which the vapor layer of helium adjacent to the surface oscillates between individual vapor bubbles and total film coverage with accompanying temperature oscillations and corresponding loss of heat transfer flux.

It is an object of this invention to provide a method and means to reduce this instability or at least partially eliminate the unstable film boiling regime thereby to increase the nucleate and film boiling heat transfer flux.

In accordance with the practice of this invention, the unstable portion of the curve between Y and Y′ is materially reduced by providing small passages in communication with the surface through which the liquid can be circulated, preferably by natural forces. Such flow of liquid through the passages for emergence from openings at the surface operate to destroy the film at low temperature differences. This has been found substantially to eliminate the dip in the curve between Y and Y′ which normally characterizes the film boiling instability region whereby the curve traverses the regime in the manner depicted by the broken lines in FIG. 1. The result is an increase both in the peak nucleate heat flux and in the minimum boiling heat flux, particularly at lower temperature differentials comprared to other techniques. The percentage of improvement will depend somewhat on the number and diameter of the passages.

The concepts of this invention have significant commercial utility. For example, the method and means of this invention provide for significant improvement in the design of super conducting magnets. Such magnets are limited in their design by the minimum film boiling heat flux for cryogenic stability. By increase of the minimum film boiling heat flux, in accordance with the practice of this invention, significant reductions in the size of the conductors used for these magnets can be achieved. It will be apparent that the invention will have application in general to other heat transfer surfaces when immersed in boiling liquids, such as evaporators used with liquified natural gas (LNG).

The invention will hereinafter by demonstrated by tests performed with liquid helium and with liquid nitrogen, using equipment of the type illustrated in FIG. 2.

The test assembly consists of a copper cylinder 10 received in fitting relation within an annular recess in a nylon block 12 immersed in a bath of liquid helium 14. Resistance wires 16 are wound about the copper cylinder 10 for use as a heater and a gold-iron thermocouple 18 is soldered to the surface for measurement of temperature differences.

The test procedures were performed with two copper cylinders one of which had a diameter of 2.54 cm and the other a diameter of 1.91 cm. Twenty-eight passages 20 having a diameter of 0.056 cm were drilled axially through the nylon block 12 and the copper cylinders having a diameter of 1.91 cm and copper tubes having an outside diameter of 0.055 cm and an inside diameter of 0.015 cm were inserted through the openings and soldered. In the case of the cylinder having a diameter of 2.54 cm, thirty passages were drilled therethrough, each having a diameter of 0.056 cm and no tubes were inserted through the passages. A third solid copper cylinder having a diameter of 1.91 cm, without passages, was used initially to obtain the boiling curve for liquid helium and the peak nucleate heat flux (PNHF) for liquid nitrogen for subsequent comparison.

The test procedures in liquid helium were all carried out in saturated liquid helium at atmospheric pressure (normal boiling point at 4.2 k) and the test procedures in liquid nitrogen were all carried out in saturated liquid nitrogen at atmospheric pressure (normal boiling point at 77.4 k).

The boiling curves of FIGS. 3, 4 and 5 depict the flux obtained in liquid helium, heat flux (q) vs. temperature difference ($\Delta T$) under three different conditions, namely (a) the copper cylinder of 1.91 cm diameter with 28 passages, (b) the copper block having 28 passages having a diameter of 0.015 cm, and (c) the copper cylinder as in (b) but with the passages blocked by means of a tape applied to the entrance to the passages at the bottom of the nylon block.

In the case of the liquid nitrogen, two boiling curves shown in FIG. 6 are obtained using the copper block as in (b) above and (d) the copper block of 2.54 cm diameter with 30 passages of 0.056 cm diameter thereethrough. A maximum nucleate boiling heat flux in nitrogen of 21 watt/cm$^2$ was first determined with the copper block without passages. This is a value consistent with the literature. The boiling curves, using a test specimen (d) with open and with blocked passages, are shown in FIG. 7. In the case of liquid nitrogen, only the nucleate region and the peak nucleate heat flux (PNHF) were measured.

It will be seen from FIGS. 5 and 6 that the peak nucleate heat flux is increased by reason of the presence of the passages which communicate through openings in the surface. In the case of liquid helium, the PNHF is increased from 0.96 $W/cm^2$ to 1.19 $W/cm^2$, corresponding to a 24% improvement, by reason of the presence of the 0.015 cm diameter openings in the surface. In the case of nitrogen, the PNHF is increased from 21 $W/cm^2$ to 24 $W/cm^2$ by reason of the presence of 0.015 cm diameter passages and to 28 $W/cm^2$ by reason of the 0.056 cm diameter passages.

In accordance with theoretical calculations, heat removed due to the surface area of the passages is less than 1.5% for specimen (b) in helium, less than 2% for specimen (b) in nitrogen, and less than 15% for specimen (d) in nitrogen.

It will be apparent therefore that the heat removed by natural circulation through the passages is neglible but the flow has a beneficial effect on the boiling phenomena at the surface.

The increase in the PNHF and the minimum film boiling heat flux (MFBH) obtained in accordance with the practice of this invention, is not associated with the high temperature differences obtained as a result of improving heat transfer characteristics by covering the surface with an insulating material.

The size of the passages is not significant, although it is desirable to make use of passages having a diameter sufficient to enable free flow of the fluid therethrough. For this purpose, use can be made of passages having a diameter greater than 0.010 cm but no greater than about 0.5 cm, and preferably within the range of 0.015–0.15 cm. More importance is attributed to the spacing between the passages and the percent of the total surface that is occupied by the openings to the passages. In this regard, the area of the openings, as a percentage of the total surface, should be within the range of 0.1–1% and preferably 0.15–0.25%. As to the spacing between the passages, it is undesirable to space the passages by an amount greater than 0.5 cm, it being understood that the closer the space between the passages the better.

Of interest is the behavior which results when the passages are covered with tape to close the passages at the bottom. In the case of the liquid helium, transition from nucleate boiling to film boiling and back to nucleate boiling is not sudden. For both liquid helium and liquid nitrogen, the heat flux appreciably decreased.

The invention has application to complete immersion of the heat transfer component into the bath of low boiling liquified gas whereby natural circulation for flow of liquid through the passages for emergence at the surface operates to prevent film formation and enhance bubble formation thereby to interfere with the formation of an unstable film boiling regime.

I claim:

1. Means for increasing heat transfer characteristics between a boiling liquid and the surface of a solid at a temperature above the temperature of the boilng liquid and in which the solid is immersed whereby an unstable vapor film ordinarily forms at the surface to interfere with the heat transfer efficiency between the surfaces of the solid and the liquid comprising providing means for eliminating at least a part of any unstable vapor film which forms on the surface of said solid, said means consisting essentially of a multiplicity of passages which extend through the solid to openings at the surface of said solid in which the openings are dimensioned to constitute up to 1% of the surface area and with the passages being dimensioned to enable circulation of liquid through said passages for emergence as a liquid from the openings at the surface for passage through any unstable vapor film formed on the surface to eliminate at least a portion of the unstable vapor film.

2. The means as claimed in claim 1 in which the openings of the passages at the surface cover 0.1–1.0% of the surface.

3. The means as claimed in claim 1 in which the openings of the passages at the surface cover 0.15–0.25% of the surface.

4. The means as claimed in claim 1 in which the passages have a diameter greater than 0.01 cm.

5. The means as claimed in claim 1 in which the passages have a diameter within the range of 0.01 to 0.50 cm.

6. The means as claimed in claim 1 in which the passages have a diameter within the range of 0.015 to 0.15 cm.

7. The means as claimed in claim 1 in which said passages are spaced one from another by an amount no greater than 0.5 cm.

8. The means as claimed in claim 1 in which the passages have a diameter within the range of 0.01–0.50 cm and are spaced one from another by an amount no greater than 0.50 cm.

9. The means as claimed in claim 1 in which the openings of the passages at the surface cover 0.1 to 1.0% of the surface, said passages having a diameter within the range of 0.01 to 0.50 cm and spaced one from another by an amount no greater than 0.50 cm.

* * * * *